US008752773B2

(12) United States Patent
Mattson

(10) Patent No.: US 8,752,773 B2
(45) Date of Patent: Jun. 17, 2014

(54) GRADE CROSSING INTERFACE PAD

(75) Inventor: Steven R. Mattson, Cheyenne, WY (US)

(73) Assignee: Voestalpine Nortrak Inc., Cheyenne, WY (US)

( * ) Notice: Subject to any disclaimer, the term of this patent is extended or adjusted under 35 U.S.C. 154(b) by 198 days.

(21) Appl. No.: 13/193,543

(22) Filed: Jul. 28, 2011

(65) Prior Publication Data

US 2013/0026246 A1 Jan. 31, 2013

(51) Int. Cl.
*E01B 21/00* (2006.01)
*E01C 9/04* (2006.01)

(52) U.S. Cl.
USPC ..... 238/9; 238/8

(58) Field of Classification Search
USPC ..... 238/5, 8, 9, 115, 265, 283
See application file for complete search history.

(56) References Cited

U.S. PATENT DOCUMENTS

| | | | | |
|---|---|---|---|---|
| 2,828,080 A | | 5/1954 | Rennels | |
| 4,117,977 A | | 10/1978 | Whitlock | |
| 4,421,272 A | | 12/1983 | Whitlock | |
| 4,445,640 A | * | 5/1984 | Caillet | 238/8 |
| 4,449,666 A | | 5/1984 | Hales et al. | |
| 4,846,401 A | | 7/1989 | Kennel | |
| 5,494,212 A | | 2/1996 | Owen | |
| 5,538,182 A | * | 7/1996 | Davis et al. | 238/8 |
| 5,626,289 A | | 5/1997 | Demers, Jr. et al. | |
| 6,422,478 B1 | | 7/2002 | Lucas, Jr. | |
| 2007/0200005 A1 | | 8/2007 | Corbett et al. | |
| 2008/0083835 A1 | | 4/2008 | Girardi et al. | |

FOREIGN PATENT DOCUMENTS

| | | |
|---|---|---|
| CA | 2281110 | 8/2007 |

* cited by examiner

*Primary Examiner* — Zachary Kuhfuss
(74) *Attorney, Agent, or Firm* — Janet Sleath; Speckman Law Group PLLC

(57) ABSTRACT

The invention relates to an interface pad comprising a stiffener supporting a resilient pad to cushion the panels in a grade crossing between and around the rails from impact with the underlying ties and to prevent the panels from moving. The pad may be flat or a cupped shape and may be of varying size to accommodate varying tie widths. The invention further comprises means to securely fasten such an interface pad to a railroad tie and minimize the possibility that the interface pad will be forcibly removed from the tie during installation of the rails or panels in the grade crossing.

17 Claims, 5 Drawing Sheets

GRADE CROSSING INTERFACE PAD

FIELD OF THE INVENTION

This invention relates to an apparatus used in railway grade crossings, specifically an interface pad to cushion the panels between and around the rails against impact and abrasion with the underlying ties and to provide uniform panel support. The invention also relates to simplifying installation of such interface pads in a railway grade crossing.

BACKGROUND OF THE INVENTION

In a grade crossing (also called a level crossing), gaps in the roadway around the railway tracks are filled in with large panels, which rest on wood or concrete ties and are approximately flush with the railheads. As vehicles pass over the crossing, the panels experience significant loading and will deflect downwardly. If a panel is not resting directly on a tie, which happens in situations where tie dimensions are not uniform, that deflection may push the panel sharply against the top surface of the tie, possibly damaging the panel, the tie or both. Repeated uncushioned impacts can eventually cause failure of the panel or tie.

It is therefore preferable to have a protective cushioning means between the panels and the ties, to act as both a shock absorber and to help absorb normal support surface variations. An interface pad is designed to cushion and support the panels and to compensate for any irregularities in the top surface of the tie that might otherwise provide a point of impact when the panels deflect against the ties as vehicles pass over.

U.S. Pat. No. 5,626,289 to Demers Jr. et al. discloses a grade crossing, and briefly refers to "known" interface pads for use between the tie and the panels, without providing any real details of the pads. Similarly, U.S. Pat. No. 4,449,666 to Hales et al. discloses a layer of elastomeric compound to separate the panels of a grade crossing from the ties, to provide flexibility to the panels and allow to adjustment of the height of the panels relative to the rail heads. However, not much more detail about the pad itself is provided.

It is known to simply place an elongated (i.e. covering substantially all of the exposed areas of the tie) interface pad over a tie once the tie is in place under a track. The drawback to this is that it creates an additional step in the installation process, as each pad, known as a conformal pad, must be hand-placed on each tie during installation. Further, because there is no physical connection between the pad and the tie, it is is difficult to ensure that the pads stay in place as the ties are installed under the rails, or as panels are installed on the ties because these situations generally require the ties or panels to be moved sideways, such that the rails or panels slide over the top surface of the ties. These sliding motions will tend to scrape any loose pads off the top of the tie.

These drawbacks have been addressed by creating shaped interface pads that interact with multiple surfaces of the tie, providing an improved fit between the tie and the pad. For example, U.S. Pat. No. 6,422,478 to Lucas Jr. and Canadian Patent No. 2281110 to Bruyn both show tie pads that are carefully shaped and engineered not only to provide cushioning pockets within the body of the interface pads, but also to fit over the top chamfers of a concrete tie, keeping the pad in place through friction and cooperation with the tie. Similarly, US Pat. App. No. 2007/0200005 to Corbett Jr. et al. describes several means to attach the pads to the tie, such as wrapping around the chamfered edges of the tie, direct attachment to the panels, and physical abutment with rail attachment hardware, ballast or roadway, but does not discuss mechanically fastening the pads to the ties. The main drawback to these shaped interface pads is that they do not address the issues of increased installation time for placing one or more pads on each tie during installation or of potential loss of the unsecured pads during or after installation.

In order to directly deal with this issue, it is known to glue an elongated interface pad, or one or more smaller interface pads, on top of the tie before shipping the tie to the installation site. However, glued-on interface pads are still highly susceptible to displacement during shipping or at any one of several points in the process involved in constructing grade crossings, which wastes money and materials.

More secure methods of connecting interface pads to ties have not gained widespread use, possibly because of the difficulties or costs associated with placing mechanical fasteners, such as bolts, into the top of a concrete tie. Further, simply bolting a flat rubber pad into the top of a tie still may not ensure that the pad stays in place during is installation, as the rubber pad can be torn off over the fastener if it is pulled with sufficient force.

It is therefore an object of the invention to provide an interface pad, specifically for use at grade crossings that overcomes one or more of the foregoing difficulties.

In particular, it is an object of the invention to provide a pre-attached interface pad for a grade crossing that eliminates the need to ship loose conformal pads to the site as well as on-site handling and installation of those conformal pads.

It is a further object of the invention to provide an interface pad that is mechanically attached to a tie, in order to eliminate undesirable movement of the pad during shipping, installation and service.

It is a further object of the invention to provide an interface pad that is manufactured and shaped for secure installation on a tie in a grade crossing.

These and other objects of the invention will be appreciated by reference to the summary of the invention and to the detailed description of the preferred embodiment that follow.

SUMMARY OF THE INVENTION

The interface pad of the invention is a two-piece system comprising a stiffener supporting a resilient cushioning pad made of a durable, elastic material. Preferably the stiffener is manufactured first, and then the resilient pad is molded onto the stiffener. The resilient pad may be divided into discrete quarters or other fractions, which helps to eliminate undesirable pad deformation during manufacture. The outer edges and corners of the resilient pad are preferably given a chamfered, beveled or rounded shape, or any shape suitable to minimize sharp or protruding parts, in order to minimize the chance that a corner or edge of the interface pad will catch on something during is transport or installation and be torn or scraped off the tie.

In an alternative embodiment, the stiffener may be encompassed substantially within the resilient pad. Preferably the stiffener is manufactured first, and then the resilient material is molded around the stiffener. In this embodiment, the stiffener may be a plate, in which case the features and functions of this embodiment of the invention are similar to those described in relation to the first embodiment. Alternatively, the stiffener may be shaped, such as in a cupped piece substantially within the resilient pad, to provide different footprints for the interface pad, which may be useful in different grade crossing situations.

The interface pad is designed to be easily mechanically attached to a tie, such as with a fastener through a hole in the pad. The fastener hole is preferably located to accommodate a fastener that can be recessed substantially or completely within the interface pad to prevent the installed fastener from interfering with the panel. The tie itself preferably has a slight recess to accommodate the interface pad, reducing the overall profile of the interface pad once it is in place on a tie, thereby minimizing the potential for displacement of the pad during handling and installation, particularly by the rails or the grade crossing panels sliding over the top surface of the tie.

In one aspect, the invention comprises an interface pad for a tie in a railway grade crossing, the interface pad having an underside to be located proximate the tie and an upper side opposed to the underside, and further comprising a stiffener; a resilient pad supported by said stiffener; and at least one fastener passageway through said stiffener and said resilient pad to accommodate a fastener to secure said interface pad to said tie, wherein the passageway may be shaped to allow the fastener to recede substantially below the upper surface of the resilient pad. The stiffener may comprise a substantially flat plate, although the passageway may extend below the underside of the plate. The stiffener may comprise a plurality of pieces, each of the pieces comprising a substantially flat plate. Alternatively, the stiffener may be cupped and located proximate the fastener passageway in a smaller pad. The overall interface pad may be substantially flat, or may be convex in shape. At least one outside edge of said resilient pad may be chamfered, beveled or rounded, and if the interface pad is a shape, such as a quadrilateral, comprising edges separated by corners, the corners may be chamfered, beveled or rounded.

In a further aspect, the resilient pad on the interface pad may comprise a plurality of sections divided by at least one channel.

In a further aspect, the stiffener may comprise at least one aperture into which the resilient pad protrudes. The aperture may be taper towards the upper side of the resilient pad, relative to the underside of the resilient pad.

In another aspect of the invention, the resilient pad of the interface pad may substantially surround the stiffener. In an embodiment wherein the stiffener comprises a substantially flat plate, the resilient pad may comprise layers of resilient material on opposed sides of the plate. The underside of the passageway extending below the substantially flat plate may not be completely within the resilient material. In an embodiment wherein the stiffener is cupped proximate said fastener passageway, the underside of the stiffener may not be completely within the resilient pad.

In yet another aspect, the invention comprises a grade crossing tie comprising at least one interface pad as described herein, and further comprising a recess in the tie to accommodate each interface pad.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The preferred embodiment of the invention will be described by reference to the drawings in which.

DETAILED DESCRIPTION OF THE INVENTION

Figure 1:
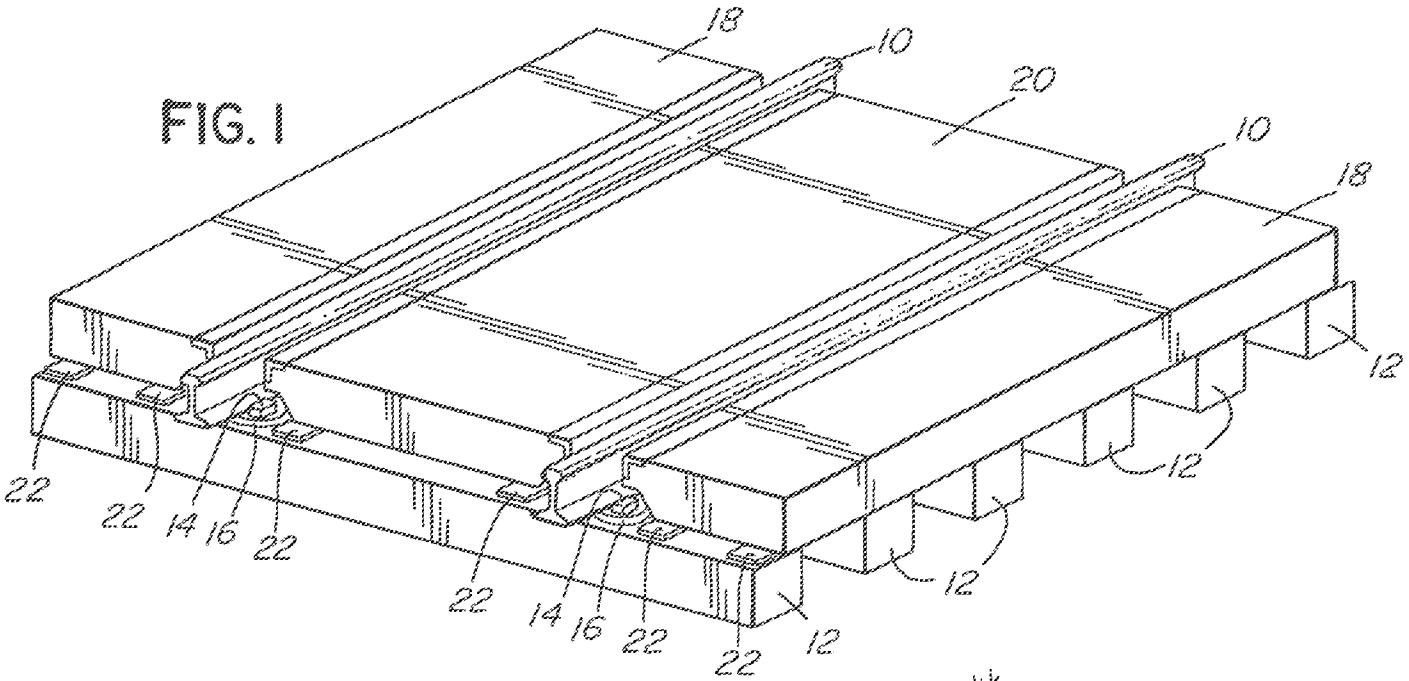
FIG. 1 is a perspective view of the interface pad of the invention in place on a tie in a typical grade crossing.
Figure 2:
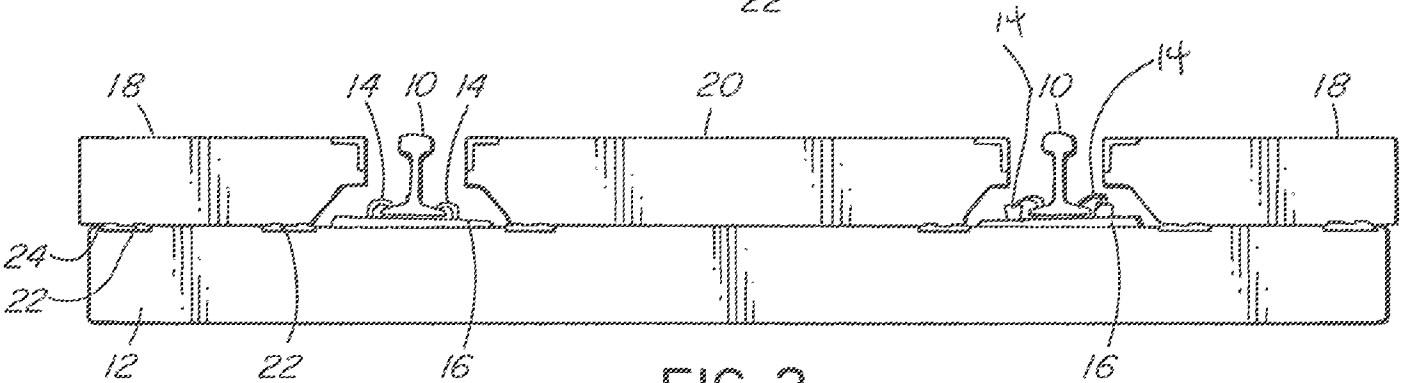
FIG. 2 is an elevation view of interface pad and grade crossing of FIG. 1.
Figure 3:
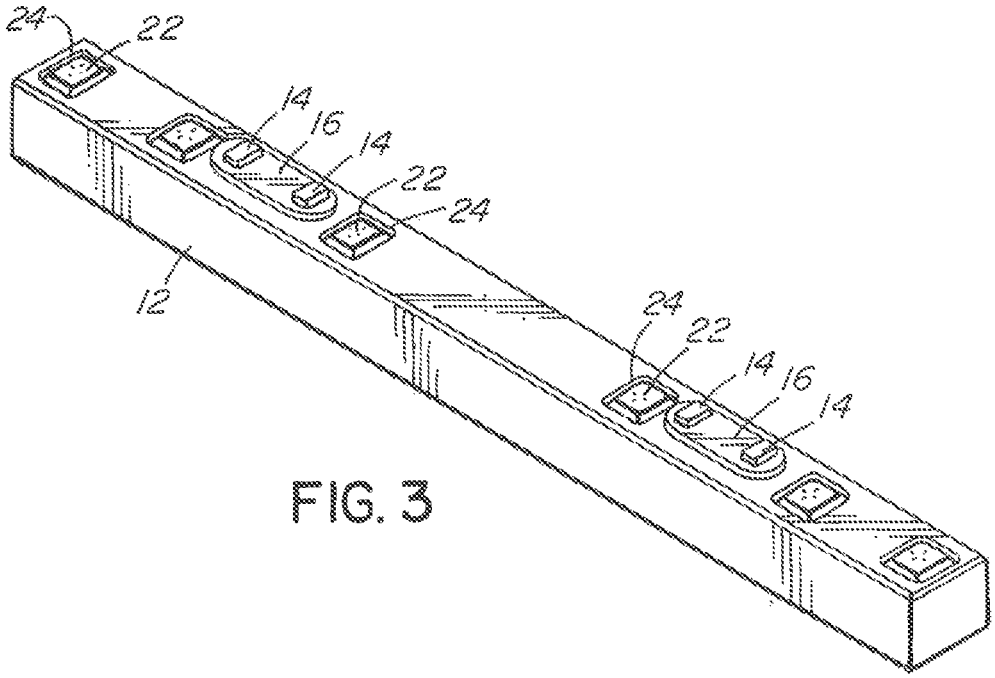
FIG. 3 is a perspective view of a tie bearing interface pads of the invention.

Referring to FIGS. 1-3, a grade crossing typically includes rails 10 supported on ties 12. Each rail 10 is fastened to the ties 12 in a standard way, such as with any suitable fastener 14, and may be seated on a supporting area, such as tie plate 16. In order to allow vehicular traffic to cross the tracks without damage, one or more panels 18 are placed on each of the field sides of the rails between the roadway and the rails, and one or more gauge side panels 20 are placed between the rails. Preferably the edges of the panels 18, 20 are shaped to fit closely around the rails 10, preventing excessive moisture and debris from penetrating the crossing. Suitable gauge and field seals (not shown) may be placed between the rails 10 and panels 18, 20 to further prevent unwanted debris from penetrating the crossing. The panels 18, 20 are also preferably similar in height to the rails 10, minimizing the shock felt by a vehicle passing over the crossing. One or more interface pads 22 are placed at suitable intervals along the tie 12, providing cushion and support for panels 18, 20. Each interface pad 22 is preferably located in a recess 24 in tie 12. It will be understood that the number of interface pads 22, and the location of those pads are shown in FIGS. 1-3 for illustration only and that the invention is not limited to a specific number of interface pads, nor to any specific location of those pads on a tie.

Figure 4:
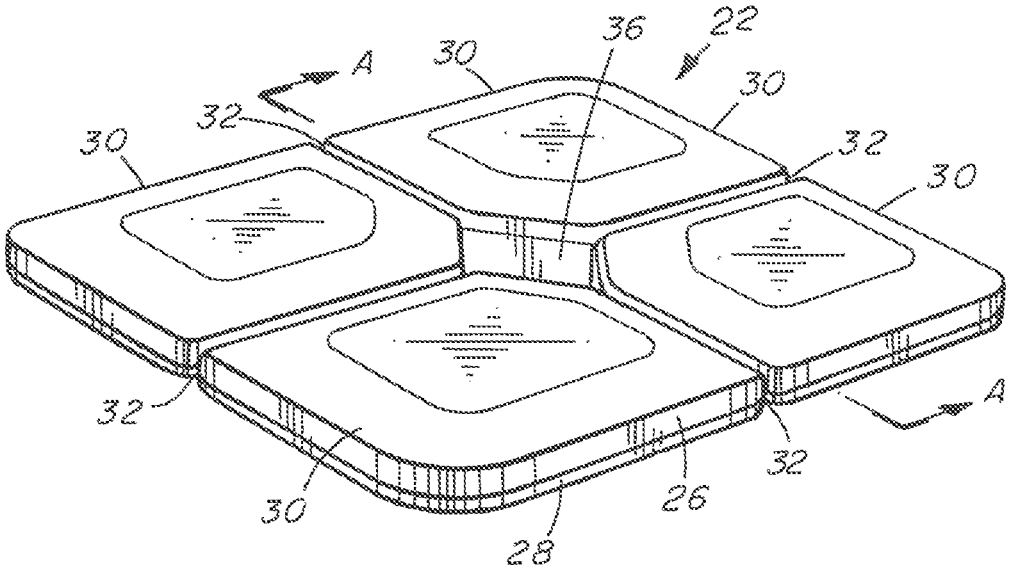
FIG. 4 is a perspective view of an interface pad of the invention.
Figure 5:
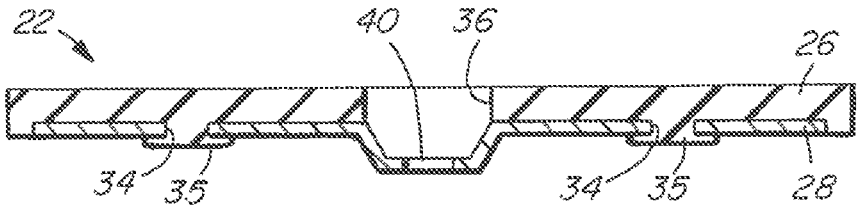
FIG. 5 is a sectional view of the interface pad of FIG. 4, taken along line A-A.

Referring now to FIGS. 4 and 5, interface pad 22 is shown as approximately rectangular, although any suitable shape may be chosen. The interface pad 22 as shown includes a resilient cushioning pad 26 supported by a stiffener 28. The stiffener 28 is preferably made of a suitable material such as steel, glass reinforced nylon, or similar material, such that the composite assembly is stiff enough to resist being pulled off the tie. The stiffener 28 is illustrated and described in these figures as a unitary plate, although it will be understood that an interface pad 22 may alternatively comprise two or more is segments making up stiffener plate 28, the segments retained as stiffener 28 by connection with resilient pad 26 as described below.

Preferably resilient pad 26 is made of a material such as rubber, artificial rubber, polyurethane, or any similarly durable and resilient material of approximately a 60-90 Shore A durometer hardness, such that the resilient pad 26 is durable enough to withstand scraping and pulling that might occur as the tie is being installed and as the grade crossing panels are being installed on the ties, while still being able to cushion and support the panels.

To manufacture the interface pad 22, the stiffener 28 may be produced first, in dimensions corresponding to the width of the rail tie 12 on which it will be disposed. The dimensions may further be selected based on the approximate shape and approximate depth of a recess 24 (shown in FIG. 2) in the tie 12. The resilient pad 26 may then be molded onto the stiffener 28. The resilient pad 26 may comprise one relatively smooth, even layer, or it may comprise two or more sections 30, which may be separated such as by channels 32. Molding resilient pad 26 in multiple sections 30 may provide advantages during the molding process, such as preventing undesirable curling or buckling of the interface pad 22.

To ensure durable contact between the resilient pad 26 and the stiffener 28, an adhesive or other suitable bonding agent may be applied between the resilient pad 26 and stiffener 28. Additionally or alternatively, the stiffener 28 may comprise apertures 34, best seen in FIG. 5, into which the warm resilient material will flow while it is being molded, mechanically interlocking the resilient pad 26 and stiffener 28, such as with plugs 35. It will be understood, although FIG. 5 shows plugs 35 extending completely through apertures 34 and under a portion of stiffener 28, plugs 35 may or may not extend completely through aperture 34, and/or may or may not flow underneath the bottom of stiffener 28. Further, aperture 34 may be tapered or stepped, such that the end 42 of the aperture 34 on the resilient pad 26 side of the stiffener 28 is narrower than the end 44 of the aperture 34 away from the resilient pad 26. This provides a wedge-shaped plug 35 that is difficult to remove from the aperture 34.

Interface pad 22 may be provided with a passageway 36 to accommodate a fastener at or near the centre of the interface pad, or at any point or points suitable to sufficiently fasten the interface pad 22 on a tie. Preferably the upper portion of the passageway 36 at the top of the resilient pad 26 has a somewhat larger diameter than the lower portion 40 of the passageway 36 where it passes through the stiffener 28. This change in diameter may be accomplished by any suitable method, such as the shoulder shown in FIG. 5, or a taper through the length of passageway 36. Providing a wider passageway 36 allows room to insert a fastener (not shown), such as a bolt or any other suitable fastening means, through the interface pad 22 and into a tie, such that the fastener head is accommodated substantially within the thickness of the resilient pad 26 and does not protrude substantially above the top surface of the interface pad 22. Alternatively or additionally, passageway 36 may extend below the level of the rest of the stiffener 28, again providing a space to accommodate a fastener substantially completely below the upper surface of the interface pad 22. Combined with the recess 24 (shown only in FIGS. 1-3), this arrangement secures the interface pad 22 to the tie while preventing the fastener from interfering with the grade crossing panels. Further, fastening the interface pad 22 onto the tie with a removable fastener allows for easy replacement of a single pad 22 if necessary, without disrupting the other pads 22 supporting the grade crossing panels. It will be understood that, instead of or in addition to providing the central fastener passageway 36, a fastener passageway may be provided in one or more of the sections 30. This may increase the overall strength of the connection between the interface pad 22 and the tie.

The recess 24 also allows a slightly thicker interface pad 22 to be installed, for example a ½" pad instead of a more typical ¼", providing better cushioning through the grade crossing without significantly increasing the overall height of a tie bearing the installed interface pads 22. This arrangement minimizes the chances that an interface pad 22 will be scraped off of a tie during shipping or installation of the grade crossing rails or is panels.

In an interface pad 22 shaped like a rectangle, as show in the figures, the corners separating the outer edges of the resilient pad 26 are preferably shaped to minimize or eliminate sharp or protruding edges, such as by providing chamfered, beveled or rounded corners, in order to minimize the chances that a corner of the interface pad 22 will catch on something during shipping or installation and be torn off the tie. It will be understood that an interface pad of a shape having corners, such as a triangle, or a square, rectangle or other quadrilateral shape, may preferably have similarly shaped corners. Further, it is preferred that all outer edges of the resilient pad 26 be similarly shaped, also in order to minimize the chances that the resilient pad 26 will catch on something.

Figure 6:
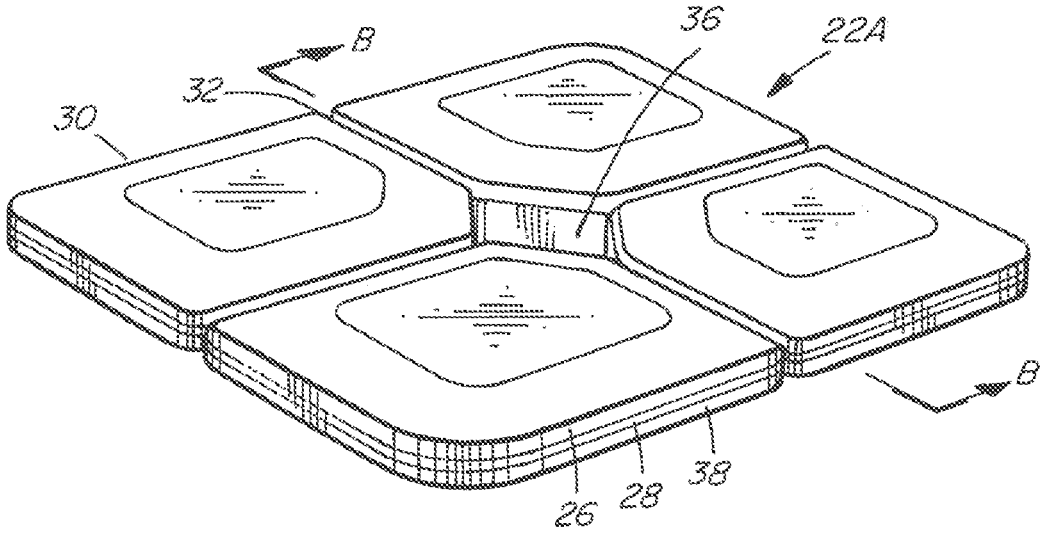
FIG. 6 is a perspective view of a second embodiment of the interface pad of the invention.
Figure 7:
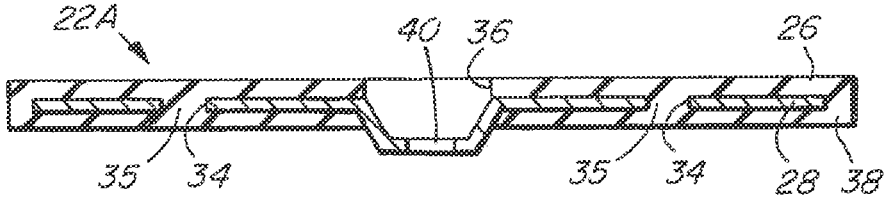
FIG. 7 is a sectional view of the interface pad of FIG. 6, taken along line B-B.

A second embodiment of the interface pad 22A is shown in FIGS. 6 and 7. This embodiment is structurally similar to that shown in FIGS. 4 and 5, except that stiffener 28 is positioned between resilient pad 26 and a second resilient pad 38. Otherwise, the foregoing description of the interface pad 22 assembly and properties is applicable to the second embodiment 22A, and similar parts are shown with the same reference numbers as those in FIGS. 4 and 5.

In any of the foregoing embodiments, the interface pad 22 may be provided with some small degree of curvature, such that the pad 22 itself is slightly convex on the upper side, as best shown in FIG. 6. When the pad 22 is installed on a tie using a fastener inserted into passageway 36, the central portion of interface pad 22 is forced to flatten out, ensuring good contact with the tie 12 in recess 24. Alternatively or in addition, the upper surface of recess 24 may be formed with some degree of curvature, such that it is convex and more likely to closely fit with the underside of the interface pad 22.

Figure 8:
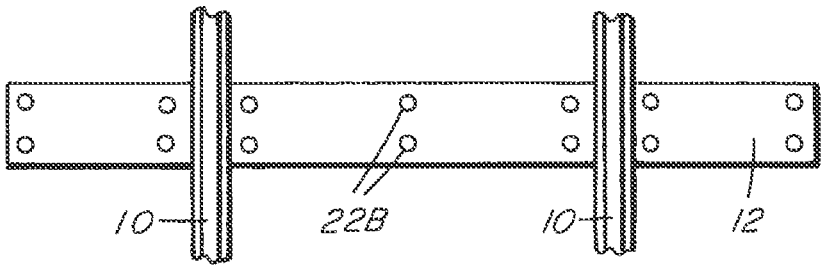
FIG. 8 is a plan view of a tie bearing an alternative embodiment of the interface pads of the invention.

In some situations, it may be preferable to use an interface pad 22 having a smaller footprint. For example, a narrower tie would require a smaller interface pad. An is interface pad with a smaller footprint relative to the size of the fastener has less pad material located some distance away from the fastener. This can increase the inherent stability of the pad, making it more difficult to remove from the tie. FIG. 8 shows a tie 12 including several smaller interface pads 22B. Again, it will be understood that the number of interface pads 22B, and the location of those pads are shown in FIG. 8 for illustration only and that the invention is not limited to a specific number of interface pads 22B, nor to any specific locations or configuration of those pads on a tie.

Figure 9:
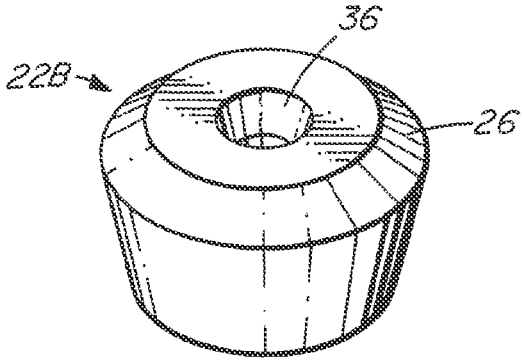
FIG. 9 is a perspective view of an alternative embodiment of the interface pad of the invention.
Figure 10:
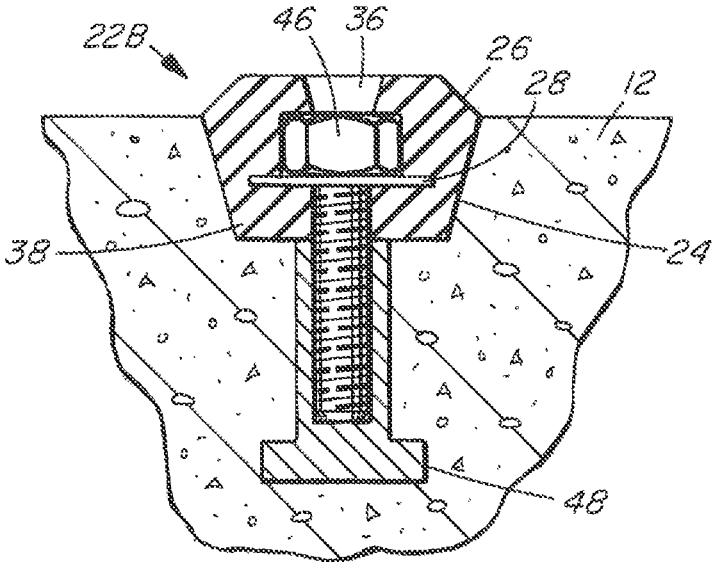
FIG. 10 is a sectional view of the interface pad of FIG. 9, taken along line C-C.

FIGS. 9 and 10 show perspective and cross-sectional views of an embodiment of interface pads 22B having a smaller footprint. In this embodiment, the resilient pad is molded above and below 26, 38 stiffener 28, which is a small plate 28. Fastener passageway 36 accommodates fastener 46, which is shown as a bolt, but which may be any suitable fastener. Recess 24 is preferably relatively deep compared to the amount of resilient pad 26 extending above the top surface of tie 12, in order to accommodate and stabilize the interface pad 22. Additional support may be provided by concrete anchor 48, which further assists in retaining fastener 46 against any lateral external forces that might try to remove the interface pad 22 from the tie 12.

Figure 11:
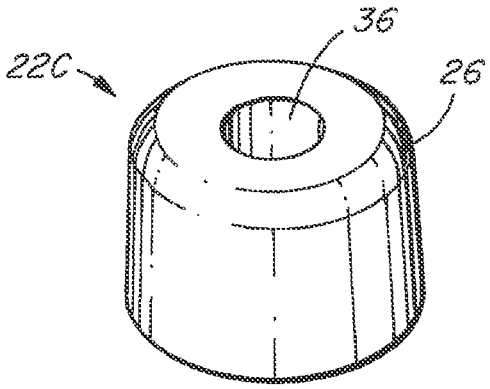
FIG. 11 is a perspective view of another alternative embodiment of the interface pad of the invention.
Figure 12:
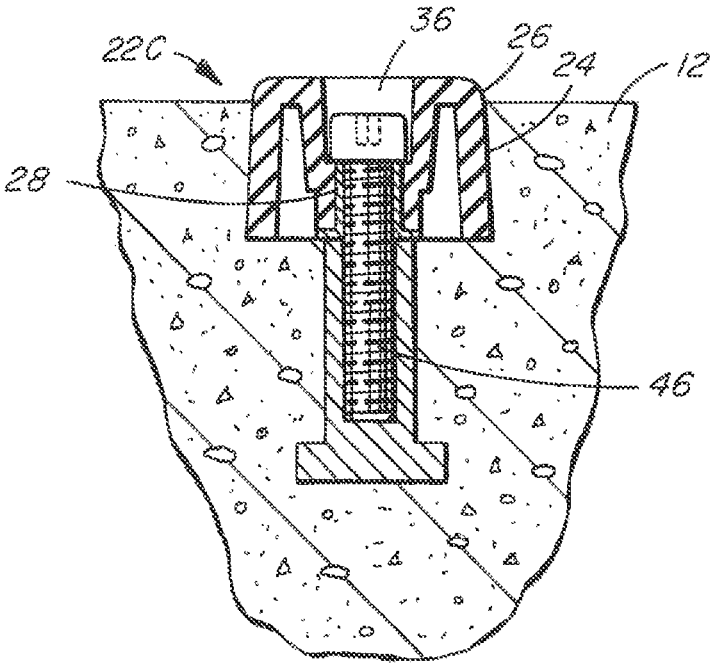
FIG. 12 is a sectional view of the interface pad of FIG. 10, taken along line D-D.

FIGS. 11 and 12 show perspective and cross-sectional views of another embodiment of interface pads 22C having a smaller footprint. In this embodiment, the stiffener 28 has a cupped shaped, positioned around the fastener passageway 36, providing support and stability directly to the fastener 46 as well as to the interface pad 22C as a whole. Otherwise, the foregoing descriptions of the interface pad 22 assemblies and properties are applicable to the fourth embodiment 22C, and similar parts are shown with the same reference numbers as those in the other figures. It will be understood that while the embodiment of the interface pad 22C is shown as an approximately circular pad, that similar shapes, such as squares, rectangles, ovals or other shapes, particularly pads having rounded, chamfered or beveled edges and/or corners, may also be used.

It will be appreciated by those skilled in the art that other variations to the preferred embodiments described herein may be practised without departing from the scope of the invention, such scope being properly defined by the following claims.

What is claimed is:

1. An interface pad for a tie in a railway grade crossing comprising a rail and at least one concrete grade crossing panel, each supported by said tie, said interface pad having an underside and an upper side opposed to said underside, and further comprising:

a stiffener;

a resilient pad stiffened by said stiffener; and at least one fastener passageway through said stiffener and said resilient pad to accommodate a fastener to secure said interface pad to said tie with said underside located on said tie and said upper side facing said panel;

wherein said passageway is shaped to allow said fastener to fit substantially below said upper side of said resilient pad, out of contact with said panel.

2. The interface pad of claim 1 wherein said stiffener comprises a substantially flat plate.

3. The interface pad of claim 2 wherein said passageway extends below said substantially flat plate.

4. The interface pad of claim 1 wherein said upper surface of said interface pad is convex.

5. The interface pad of claim 1 wherein said stiffener is cupped and located proximate said fastener passageway.

6. The interface pad of claim 1 wherein at least one outside edge of said resilient pad is chamfered, beveled or rounded.

7. The interface pad of claim 1 wherein said interface pad is a quadrilateral shape comprising edges separated by corners, said corners being chamfered, beveled or rounded.

8. The interface pad of claim 1 wherein said resilient pad comprises a plurality of sections divided by at least one channel.

9. The interface pad of claim 1 wherein said stiffener comprises at least one aperture into which said resilient pad protrudes.

10. The interface pad of claim 9 wherein said at least one aperture tapers towards the upper side of said resilient pad, relative to the underside of said resilient pad.

11. The interface pad of claim 1 wherein said fastener is a bolt.

12. The interface pad of claim 1 wherein said resilient pad substantially surrounds said stiffener.

13. The interface pad of claim 12 wherein said stiffener comprises a substantially flat plate and said resilient pad comprises layers of resilient material on each of said upper side and underside of said plate.

14. The interface pad of claim 13 wherein said passageway extends from the underside of said substantially flat plate and said passageway protrudes from said layers of resilient material.

15. The interface pad of claim 12 wherein said stiffener is cupped and located proximate said fastener passageway and the underside of said stiffener protrudes from said layers of resilient material.

16. The interface pad of claim 1 wherein said stiffener comprises a plurality of pieces, each of said pieces comprising a substantially flat plate.

17. A tie for a grade crossing comprising at least one interface pad as claimed in claim 1, and further comprising a recess in said tie to accommodate each said interface pad.

* * * * *